United States Patent [19]

Demi

[11] 4,242,083

[45] Dec. 30, 1980

[54] FLUID FLOW SENSING SWITCH DEVICE

[75] Inventor: Roy C. Demi, Greensburg, Pa.

[73] Assignee: Robertshaw Controls Company, Richmond, Va.

[21] Appl. No.: 936,113

[22] Filed: Aug. 23, 1978

[51] Int. Cl.[3] ..... H01H 35/34; H01H 35/40; F23N 5/06

[52] U.S. Cl. ..... 431/72; 137/119; 137/503; 200/83 A; 200/83 Q; 200/83 N; 200/61.86; 251/634; 431/89

[58] Field of Search ..... 200/83 R, 83 A, 83 F, 200/83 Q, 83 N, 83 L, 61.86; 251/61.4, 63.4; 431/72, 89; 137/111, 119, 503

[56] References Cited

U.S. PATENT DOCUMENTS

| | | | |
|---|---|---|---|
| 1,931,475 | 10/1933 | Brasch | 200/83 A |
| 2,800,544 | 7/1957 | Caparone | 200/61.86 |
| 3,164,414 | 1/1965 | Stelzer | 200/83 Q |
| 3,475,746 | 10/1969 | Nelson | 200/83 N |
| 4,081,621 | 3/1978 | Hartley | 200/83 Q |

*Primary Examiner*—George E. Lowrance
*Attorney, Agent, or Firm*—Candor, Candor & Tassone

[57] ABSTRACT

A fluid flow sensing device having a housing provided with a fluid flow passage therethrough defined by an inlet and outlet separated by a valve seat controlled by a movable valve member that is operated by a pressure differential between the inlet and the outlet acting on a flexible diaphragm carried by the housing, the device having an electrical switch construction operatively associated with the valve member and having the switch contacts thereof disposed in the fluid flow passage so as to be exposed to fluid therethrough and being actuated by the pressure differential acting on the flexible diaphragm. The switch contacts comprise a pair of spaced apart contacts carried by the flexible diaphragm and a bridging contact member carried by the valve member and being adapted to make contact with the pair of contacts and thereby bridge the pair of contacts to close the switch construction to operate electronic switching, the electronic switching being disposed inside the housing.

39 Claims, 10 Drawing Figures

FLUID FLOW SENSING SWITCH DEVICE

BACKGROUND OF THE INVENTION

1. Field of the Invention

This invention relates to an improved fluid flow sensing switch device and method of making the same as well as to fuel control system utilizing such device for controlling the operation of electrical ignition means for a burner means of the fuel control system.

2. Prior Art Statement

It is known to applicant to provide a fluid flow sensing switch device having a housing means provided with a fluid flow passage therethrough defined by an inlet and outlet separated by a valve seat controlled by a movable valve member that is operated by a pressure differential between the inlet and the outlet acting on a flexible diaphragm carried by the housing means, the device having an electrical switch construction operatively associated with the valve member and having contact means thereof disposed in the fluid flow passage so as to be exposed to fluid flow therethrough and being actuated by the pressure differential acting on the flexible diaphragm.

For example, see the following copending U.S. patent application:

1. Ser. No. 936,112, filed Aug. 23, 1978.

The fluid flow sensing switch device of item (1) above has one contact of the electrical switch construction carried by the flexible diaphragm, that actuates the switch construction and the movement of the valve member by sensing the pressure differential between the inlet and the outlet across the same, and has the other contact of the switch construction carried on the valve member to be contacted by the diaphragm contact when the diaphragm moves its contact against the valve member carried contact so that the switch construction will be closed before the diaphragm can move the valve member to an open position thereof.

It is also known to applicant to provide an electronic switching circuit to be controlled by the switch construction of such a fluid flow sensing switch device so that a relatively small current flow can be controlled by the switch construction of the fluid flow sensing switch device to eliminate any buildup of carbon on the contacts thereof while permitting the electronic switching means to control a large current flow for operating the burner ignition means.

For example, see the following copending U.S. patent application:

(2) Ser. No. 936,116, filed Aug. 23, 1978.

The electronic switching circuit of item (1) is located external to the fluid flow sensing switch device that carries the switch construction for operating such electronic switching means.

SUMMARY OF THE INVENTION

It is feature of this invention to provide a fluid flow sensing switch device that is relatively compact while being relatively easy to manufacture and assemble.

In particular, it was found according to the teachings of this invention that the aforementioned prior known fluid flow sensing switch device required the leads from the contacts of the switch construction thereof be attached to terminal means carried by the main body of the housing construction.

However, it was found according to the teachings of this invention that the contact means of the electrical switch construction can be rearranged so that the lead connections therefrom to the terminal means could be completely disposed within the control chamber of the fluid flow sensing switch device and thereby be interconnected to terminal means carried by a cover member of the housing means rather than by the main body thereof.

In addition, it was found that with such a unique contact arrangement, the use of electronic switching means in combination with the switch construction permitted the electronic switching means to be likewise located in the control chamber whereby substantially all of the electrical components of the fluid flow sensing switch device of this invention can be carried by the cover member of the housing means and its associated flexible diaphragm to minimize subsequent field repair and replacement time for such device.

It was also found according to the teachings of this invention that the valve member of the fluid flow sensing switch device could be improved and, if desired, carry the restriction means for interconnecting the inlet of the housing means to the outlet thereof.

In particular, one embodiment of the fluid flow sensing switch device of this invention has a housing means provided with a fluid flow passage therethrough defined by an inlet and an outlet separated by a valve seat controlled by a movable valve member that is operated by the pressure differential between the inlet and the outlet acting on a flexible diaphragm carried by the housing means, the device having an electrical switch construction operatively associated with the valve member and having the contact means thereof disposed in the fluid flow passage so as to be exposed to fluid flow therethrough and being actuated by the pressure differential acting on the flexible diaphragm. The contact means comprise a pair of spaced apart contacts carried by the flexible diaphragm and a bridging contact member carried by the valve member and being adapted to make contact with the pair of contacts and thereby bridge the pair of contacts to close the switch construction.

If desired, the switch construction of such fluid flow sensing switch device can operate electronic switching means and the electronic means can be disposed inside the housing means of the device of this invention.

Accordingly, it is an object of this invention to provide an improved fluid flow sensing switch device having one or more of the novel features of this invention as set forth above or hereinafter shown or described.

Another object of this invention is to provide a method of making such a fluid flow sensing switch device, the method of this invention having one or more of the novel features of this invention as set forth above or hereinafter shown or described.

Another object of this invention is to provide a fuel control system utilizing such a fluid flow sensing switch device, the fuel control system of this invention having one or more of the novel features of this invention as set forth above or hereinafter shown or described.

Other objects, uses and advantages of this invention are apparent from a reading this description which proceeds with reference to the accompanying drawings forming a part thereof and wherein:

DESCRIPTION OF THE PREFERRED EMBODIMENTS

Figure 1:
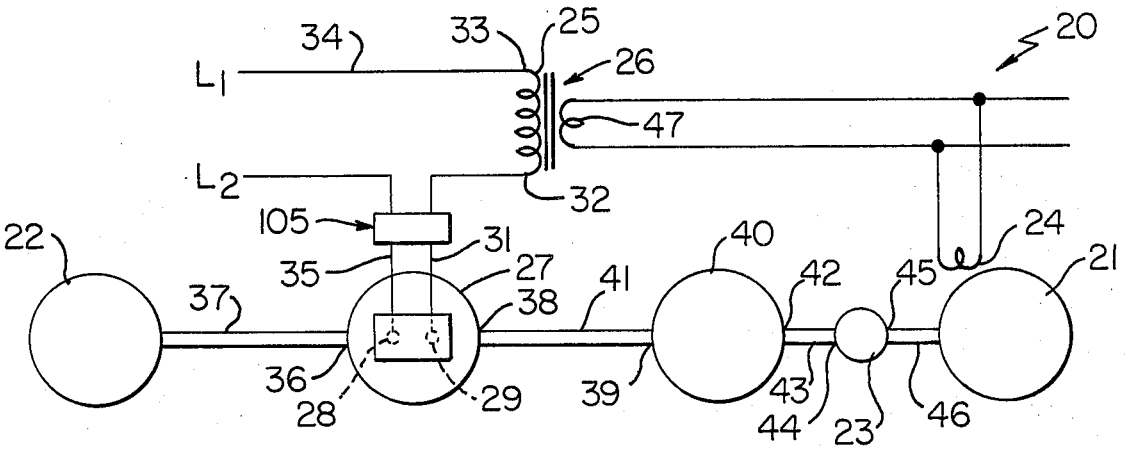
FIG. 1 is a schematic view illustrating the fuel control system of this invention that includes the fluid flow sensing switch device of this invention.

While the various features of this invention are hereinafter described and illustrated as being particularly adapted to provide a fluid flow sensing switch device for a fuel control system, such is for a cooking apparatus or the like, it is to be understood that the various features of this invention can be utilized singly or in any combination thereof to provide a fluid flow sensing switch device for other types of apparatus as desired.

Therefore, this invention is not to be limited to only the embodiments illustrated in the drawings, because the drawings are merely utilized to illustrate one of the wide variety of uses of this invention.

Referring now to FIG. 1, the improved fuel control system of this invention is generally indicated by the reference numerial 20 and is being utilized for controlling the operation of a main burner means 21 of a cooking apparatus or the like (not shown) that is adapted to receive gaseous fuel from a fuel source 22 when a conventional "on-off" valve 23 for the burner means 21 is turned an "on" condition thereof whereby the fuel issuing from the burner means 21 is adapted to be ignited by an electrically operated ignitor coil 24 disposed adjacent thereto and being energized when electrical current is permitted to flow through a primary coil 25 of a transformer means 26 when a fluid flow sensing switch device 27 of this invention causes an electrical connection between a pair of terminal means 28 and 29 of an electrical switch construction 30 thereof (FIG. 3) upon the sensing of a flow of fuel from the device 27 toward the burner means 21 in the manner hereinafter described.

The terminal 29 of the switch construction 30 is adapted to be electrically interconnected by a lead means 31 to one side 32 of the primary coil 25 of the transformer means 26 while the other side 33 of the primary coil 25 is interconnected by a lead means 34 to a main power source lead L1.

The other terminal means 28 of the switch construction 30 is adapted to be interconnected by a lead means 35 to the other main power source lead L2 as illustrated in FIG. 1.

If desired, an electronic switching unit that is generally indicated by reference numerial 105 in FIGS. 1 and 7 can be disposed in the lead means 31 and 35 for a purpose hereinafter described.

The fuel source 22 is adapted to be interconnected to the inlet side 36 of the fluid flow sensing switch device 27 of this invention by a conduit means 37 while the outlet side 38 of the device 27 is adapted to be interconnected to the inlet side 39 of a conventional pressure regulator 40 by a conduit means 41. The outlet side 42 of the pressure regulator 40 is adapted to be interconnected by conduit means 43 to the inlet side 44 of the "on-off" valve 23 that has its outlet side 45 interconnected by a conduit means 46 to the burner 21.

While the system 20 is illustrated as having only one burner 21 and one ignitor coil 24 respectively therefor, it is to be understood that the system 20 could have a plurality of burners 21 and each have an ignitor coil 24 therefor that is also electrically interconnected to a secondary winding 47 of the transformer means 26 in any suitable manner.

For example, the ignition coil 24 can be of the type set forth in the U.S. patent to Branson, U.S. Pat. No. 4,003,360 or set forth in the U.S. patent to Grayson et al, U.S. Pat. No. 3,898,403.

In any event, it can be seen that the fuel control system 20 is so constructed and arranged that each time the "on-off" valve 23 is turned to an "on" condition thereof, fuel is adapted to flow from the fuel source 22 to the burner 21, the device 27 of this invention being so constructed and arranged in a manner hereinafter set forth that the same senses the opening of the valve 23 in a manner to cause the terminal means 28 and 29 to be electrically interconnected together to operate the ignitor 24 before the device 27 permits fuel to flow therethrough from the source 22 to the burner means 21. In this manner, by the time the fuel flows through the pressure regulator 40 to the burner means 21 to issue therefrom, the ignition coil 24 is already operating to ignite the fuel flow from the burner 21.

The ignitor coil 24 remains in an energized condition thereof as long as the fuel continues to flow from the source 22 through the device 27 to the burner 21 as will be apparent hereinafter.

Thereafter, when the operator closes the "on-off" valve 23, the device 27, sensing the closing of the valve means 23 in a manner hereinafter set forth, subsequently not only disconnects the conduits 37 and 41 from each other, but also disconnects the terminals 28 and 29 of the switch construction 30 to terminate the operation of the ignition coil 24.

The details of the improved fluid flow sensing switch device 27 of this invention and the method of this invention for making the same will now be described and reference is made to FIGS. 3–6 wherein it can be seen that the device 27 has a housing means 48 that includes an inlet 49 and an outlet 50 separated from each other by a resilient valve seat 51 that is adapted to be opened and closed by a valve member 52 movably carried by the housing 48 in a manner hereinafter described.

In this manner, the inlet 49 and outlet 50 provide a fluid flow path through the housing means 48 adapted to be respectfully interconnected to the conduits 37 and 41 for the purpose previously described.

A flexible diaphragm 53 has its outer peripheral portion 54 secured to the housing means 48 by being held between a main body part 55 thereof and a cover plate 56 thereof fastened to the body part 55 by threaded fastening means 57 whereby the side 58 of the flexible diaphragm 53 cooperates with the housing part 55 to define part of the outlet 50 thereof and the other side 59 of the flexible diaphragm 53 cooperates with the cover part 56 to define a control chamber 60 therewith that is sealed from the outlet 50 by the flexible diaphragm 53.

The housing means 48 of the device 27 has an open passage 61 therein that interconnects the inlet 49 to the control chamber 60 and has a restricted passage 62 that interconnects the inlet 49 with the outlet 50 for a purpose hereinafter described.

Figure 3:
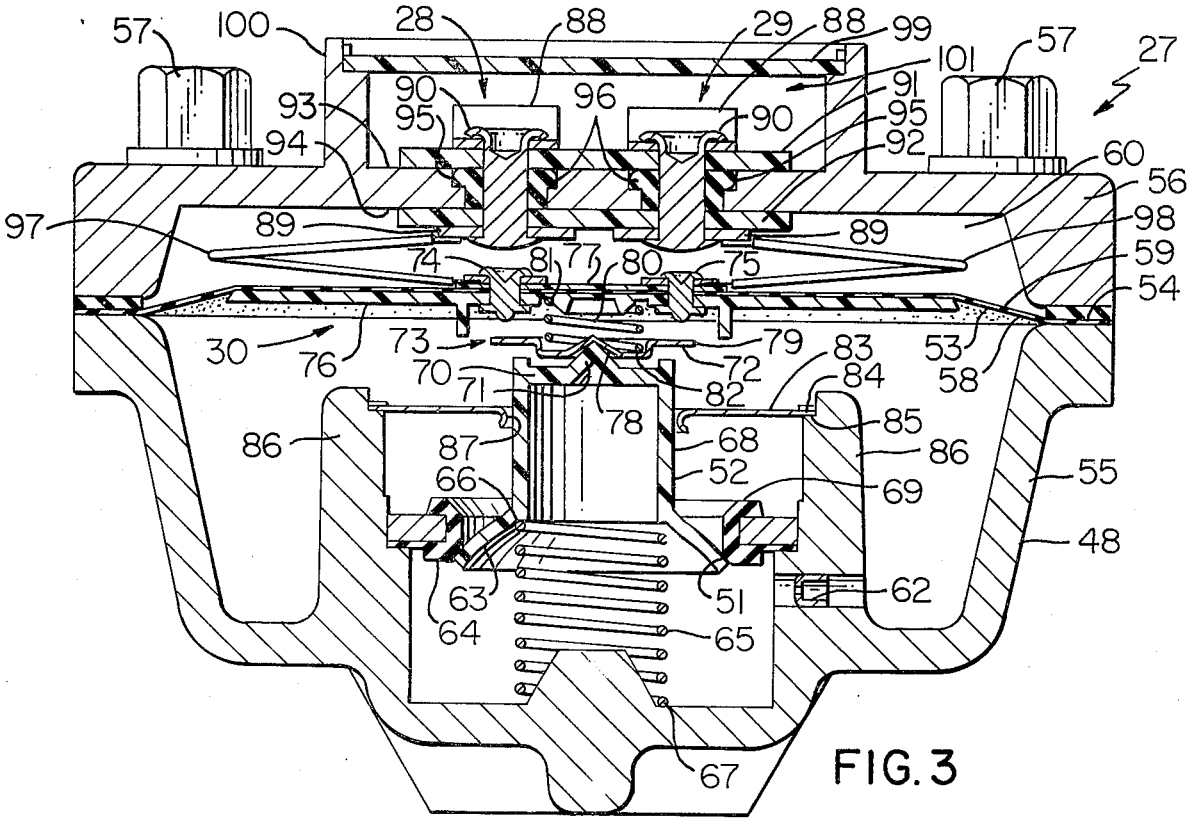
FIG. 3 is a cross-sectional view taken on line 3—3 of FIG. 2.

The valve member 52 comprise a hollow plastic one-piece part that has an enlarged end section 63 adapted to be disposed on the side 64 of the valve seat 59 to close against the same in the manner illustrated in FIG. 3 by the force of a compression spring 65 having one end 66 bearing against the valve member 52 and the other end 67 bearing against the housing means 48.

A substantially cylindrical stem part 68 of the valve member 52 projects through the valve seat 51 beyond the other side 69 thereof and terminates in a closed end wall 70 which has a central pointed projection 71 to swivelly or universally mount a bridging contact member 72 thereon that forms part of the contact means 73 for the electrical switch construction 30.

In particular, the contact means 73 for the switch construction 30 includes a pair of spaced apart contacts 74 and 75 carried in rivet-like fashion by the flexible diaphragm 59 to not only be fastened thereto but to also fasten nonconductive reinforcing plates 76 and 77 respectively to the sides 58 and 59 of the diaphragm 53 as illustrated in FIG. 3.

Figure 4:
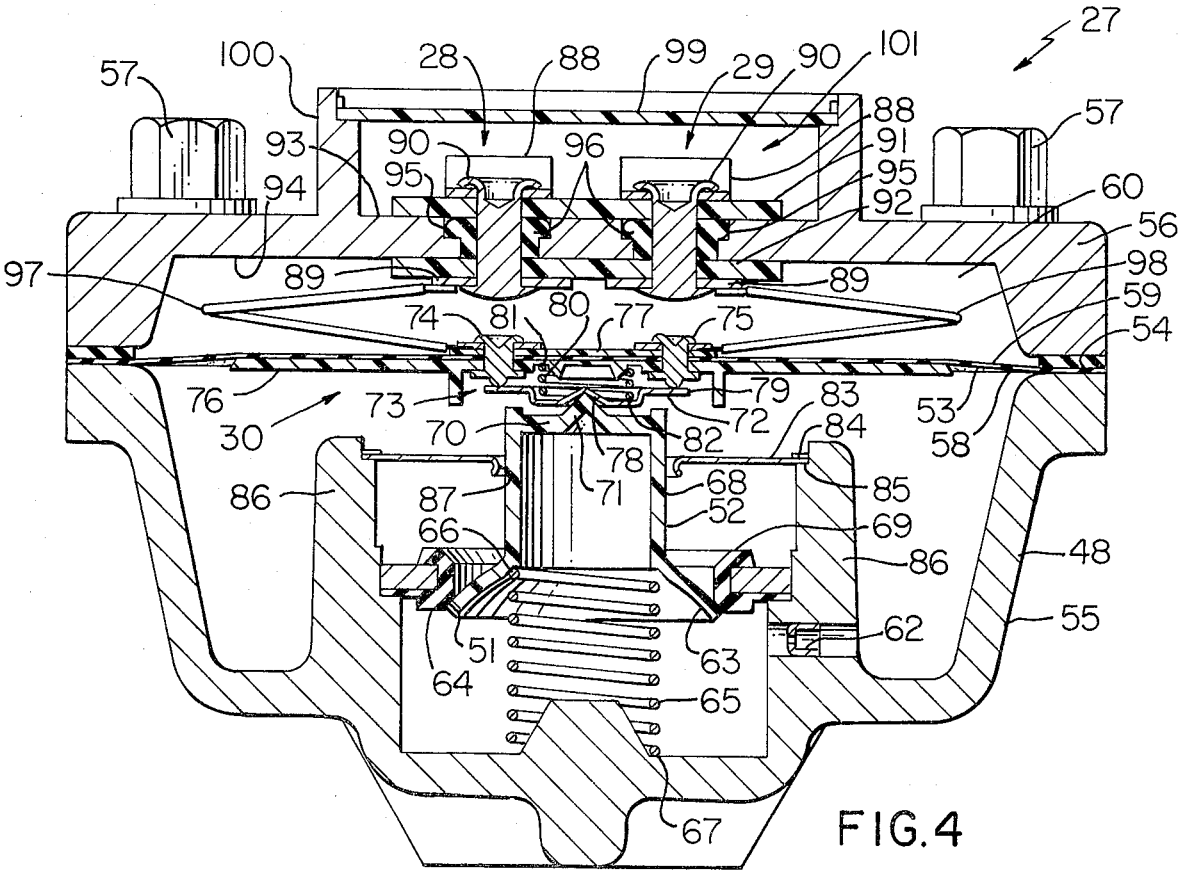
FIG. 4 is a view similar to FIG. 3 and illustrates the fluid flow sensing switch device in a different operating condition thereof.

The contact means 73 of the switch construction 30 also includes the conductive bridging contact member 72 which is disc-like and has a pointed concave surface 78 receiving the pointed abutment 71 of the valve member 52 therein so that the bridging contact member 72 is universally mounted in a pivoted manner on the upper end 70 of the valve member 52 and has its outer peripheral portion 79 adapted to make contact with the pair of contacts 74 and 75 as illustrated in FIG. 4 and thereby bridge the same so as to close the switch construction 30 and thereby electrically interconnect the terminals 28 and 29 together as will be apparent hereinafter.

However, a small compression spring 80 is disposed between the flexible diaphragm 53 and the bridging contact member 72 by having one end 81 thereof bearing against the diaphragm 53 and the other end 82 bearing against the bridging contact member 72 to normally tend to hold the bridging contact member 72 and the flexible diaphragm 53 in the spaced apart relation illustrated in FIG. 3 so that the bridging member 72 is out of contact with the pair of contacts 74 and 75. In this manner, the contact means 73 of the switch construction 30 is normally disposed in an open condition as will be apparent hereinafter.

The force of the main compression spring 75 is much greater than the force of the compression spring 80 as will be apparent hereinafter.

A washer-like guide member 83 is carried by the housing means 48 by having its outer peripheral portion 84 staked or otherwise secured to shoulder means 85 of a plurality of upstanding ribs or projections 86 of the housing part 55 so that the washer-like guide member 53 is disposed in spaced relation on the side 69 of the valve seat 51 and closely receives the valve stem part 68 of the valve member 52 through a central opening means 87 thereof so that the movement of the valve member 52 relative to the valve seat 51 will be guided by the guide member 83 as will be apparent hereinafter.

The terminal means 28 and 29 for the device 27 are respectively carried by the cover member 56 of the housing part 48 and each includes a first part 88 formed as a plug-in prong external to the cover member 56 and being electrically interconnected to a second part 89 of the respective terminal means 28 or 29 that is disposed internally of the housing means 48 by a rivet-like electrical connector 90 respectively fastening the parts 88 and 89 to insulating plates 91 and 92 respectively disposed on opposite sides 93 and 94 of the cover member 56. Each rivet-like member 90 passes through opening means 95 of the cover member 56 which is sealed closed by annular sealing means 96 disposed around the respective rivet member 90 as illustrated.

The electrical contacts 74 and 75 are respectively electrically interconnected to the second parts 89 of the terminal means 28 and 29 by flexible lead means 97 and 98 respectively disposed within the control chamber 60 of the device 27.

Figure 2:
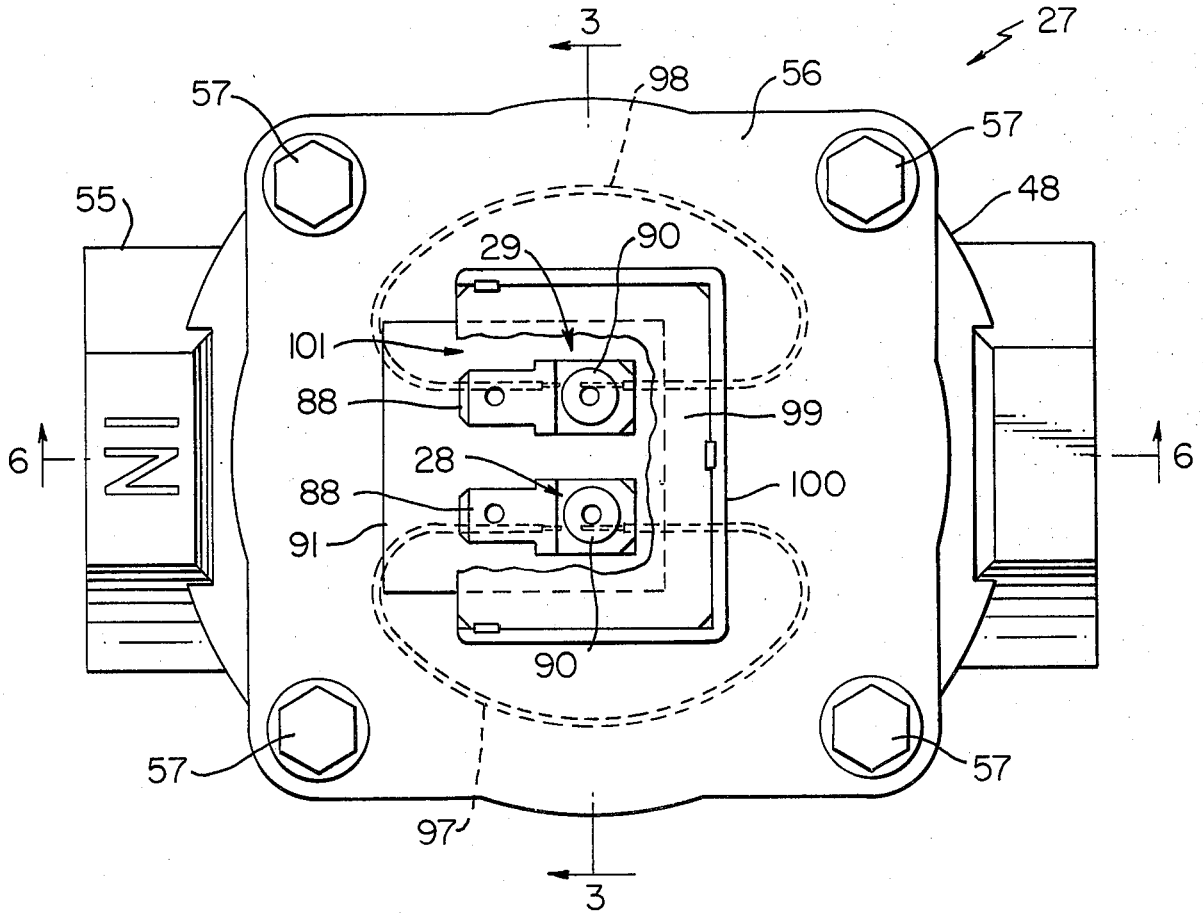
FIG. 2 is an enlarged top view of the fluid flow sensing switch device of this invention that is schematically illustrated in FIG. 1.

In this manner, it can be seen that all of the switch construction 30, except for the bridging contact member 72, is either carried by the flexible diaphragm 53 or the cover member 56 so that the electrical connection to the device 27 can take place by the terminal means 28 and 29 having the prongs 88 thereof plugged into a suitable socket-like receptacle inserted between the side 93 of the cover member 56 and a smaller cover plate 99 spaced from the side 93 and being fastened to an upstanding three sided rib means 100 of the cover member 56 to define an opening 101, FIG. 2, into which such socket-type receptacle can be inserted to respectively interconnected the terminals 28 and 29 to the leads 35 and 31. Thus, the device 27 can be easily interconnected into the system 20 as illustrated in FIG. 1.

Therefore, it can be seen that the fluid flow sensing switch device 27 of this invention can be made by the method of this invention as previously described in a relatively simple and inexpensive manner to operate in a manner now to be described.

When the fluid flow sensing switch device 27 of this invention is disposed in the fuel control system 20 previously described, and the "on-off" valve 23 is in the "off" condition thereof, it can be seen that the inlet 49 of the device 27 is directly interconnected to the fuel source 22 so that the pressure of the fuel in the inlet 49 is the same as in the control chamber 60 because of the open passage 61 and such pressure tends to operate on the side 59 of the diaphragm 53 to move the same downwardly in opposition to the force of the compression sprngs 80 and 65. However, with the "on-off" valve 23 is in its closed condition, the outlet 50 of the device 27 is adapted to be at the same pressure as the inlet 49 as the restrictive passage 62 permits the outlet 50 to increase its pressure value to the same pressure valve as in the inlet 49 and since the pressure in the outlet 50 is now the same as the pressure in the control chamber 60, the fluid pressure acting on the opposite sides 58 and 59 of the diaphragm 53 balance each other so that the force of compression springs 80 and 65 hold the diaphragm 53 in its uppermost condition as illustrated in FIG. 3. Thus, not only is the valve member 52 held against the valve seat 51, but also the bridging contact member 72 is held away from the pair of contacts 74 and 75 so that the switch construction 30 is in the open condition thereof to prevent the operation of transformer 26 and, thus, the energizing of the ignition coil 24.

However, when the operator desires to utilize the burner means 21, the operator opens the "on-off" valve 23. The initial opening of the "on-off" valve 23 vents the pressure in the outlet 50 of the device 27 through the burner 21 so that the initial pressure drop between the inlet 49 and outlet 50 results in a corresponding pressure drop across the diaphragm 53 caused by the pressure in the control chamber 60 now being higher than in the outlet 50 because the restricted passage 62 cannot maintain the pressure in the outlet 50 at the same rate as the open passage 61 to the control chamber 60. Thus, the diaphragm 53 is moved downwardly by the resulting pressure differential across the same in opposition to the force of the compression springs 80 until the pair of contacts 74 and 75 make contact with the bridging contact 72 as illustrated in FIG. 4 to cause closing of the switch construction 30 and, thus, operation of the transformer 26 to energize the ignition coil 24 in the manner previously described.

Figure 5:
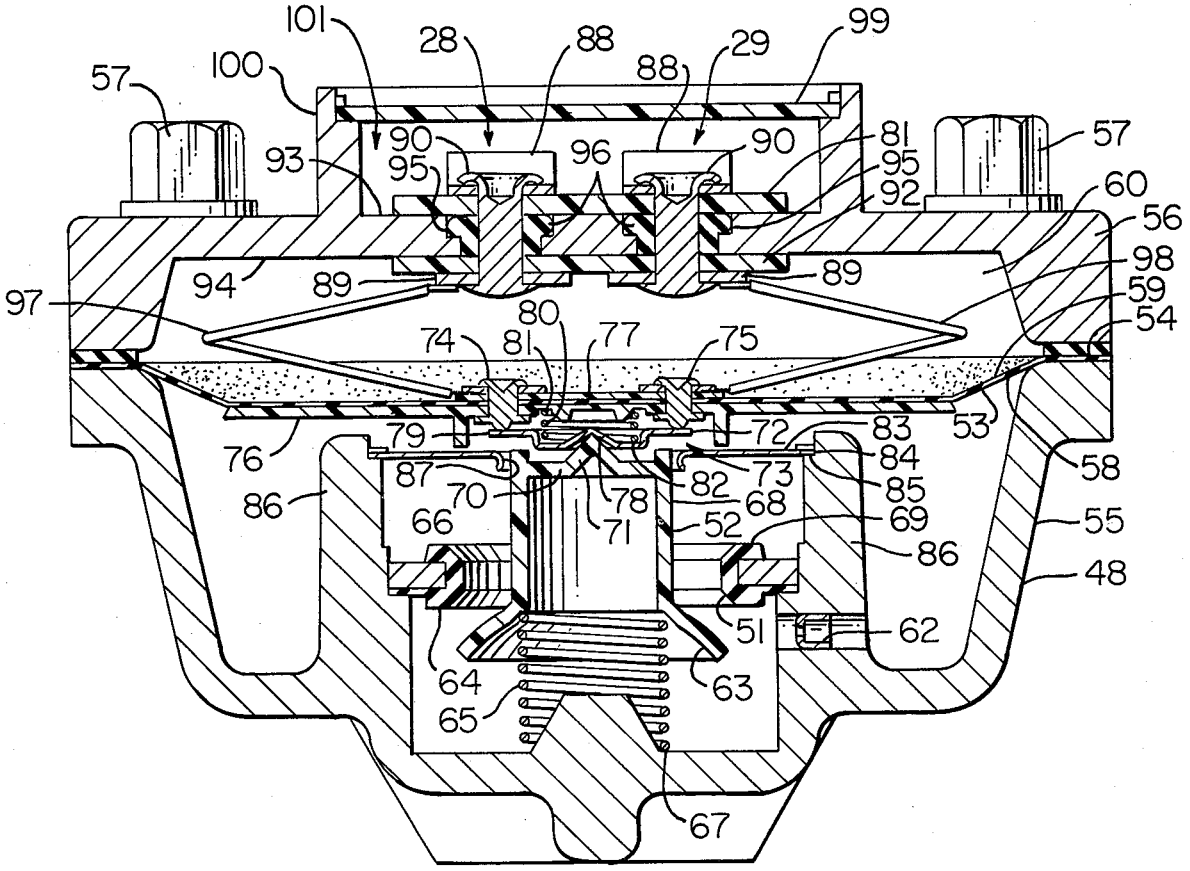
FIG. 5 is a view similar to FIGS. 3 and 4 and illustrates the fluid flow sensing switch device in still another operating condition thereof.

Further downward movement of the diaphragm 53, because of the pressure differential acting across the same, causes the pair of contacts 74 and 75 to move the bridging contact 72 downwardly therewith in opposition to the force of the main compression spring 65 which movement, of course, causes the valve member 52 to open away from the valve seat 51 in the manner illustrated in FIG. 5 to permit fuel in sufficient quantity to now flow from the source 22 through the device 27, pressure regulator 40 and open valve means 23 to the burner 21 and be ignited by an ignitor coil 24 as the same issues therefrom.

As long as the "on-off" valve 23 remains in the "on" condition thereof, fuel continuously flows from the source 22 to the burner 21 at the pressure determined by the setting of the pressure regulator 40 and since the device 27 remains in the open condition as illustrated in FIG. 5 during this time, the switch construction 30 remains in its closed condition and the ignition coil 24 remains in its energized condition.

However, should the operator subsequently close the "on-off" valve 23, the closing of the valve 23 stops the flow of fuel to the burner 21 and now causes the pressure in the outlet 50 of the device 27 to build up, by the fuel still passing through the opened valve seat 51, until the pressure in the outlet 50 is substantially the same as the pressure in the inlet 49 and, thus, the control chamber 60. In this manner, the pressure differential acting across the diaphragm 53 decreases so that the force of the compression spring 65 first causes the valve member 52 to close against the valve seat 51 in the manner illustrated in FIG. 4 and then further upward movement of the diaphragm 53 by the force of compression spring 80 causes the pair of contacts 74 and 75 to move away from the bridging contact member 72 in the manner illustrated in FIG. 3 to thereby open the switch construction 30 and terminate the operation of the transformer means 26 whereby the ignition coil 24 is now deenergized.

Thus, as long as the "on-off" valve 23 remains in the "off" condition thereof, the pressure in the outlet 50 remains the same as the pressure in the inlet 49 because of the restricted passage 62 whereby the diaphragm 53 remains in the up condition illustrated in FIG. 3 so that not only is the valve member 52 in its closed condition against the valve seat 51, but also the switch construction 30 is in the opened condition thereof.

Therefore, it can be seen that not only does the location of the contact means 73 of the switch construction 30 in the outlet 50 of the fluid flow passage of the device 27 render the device 27 relatively compact, but also such arrangement of the contact means 73 readily permits the fluid flow sensing switch device 27 to close the switch construction 30 before the valve member 52 thereof is moved to an open condition relative to the valve seat 51 as set forth in the aforementioned copending patent application, Ser. No. 936,112. Conversely, the location of the contact means 73 permits the valve member 52 to close before the switch construction 30 is opened as also set forth in the aforementioned copending patent application, Ser. No. 936,112.

Further, by forming the contact means 73 as a pair of spaced apart contacts 74 and 75 carried by the diaphragm 53 in accordance with the teachings of this invention, it can be seen that the terminals 28 and 29 for the system 20 can be carried by the cover member 56 of the housing means 48 to permit the electrical connection leads 97 and 98 to be disposed in the control chamber 60 so that the main housing body 55 need not carry any terminal means thereof in the fluid flow path therethrough as provided in the prior described fluid flow sensing switch device.

Figure 7:
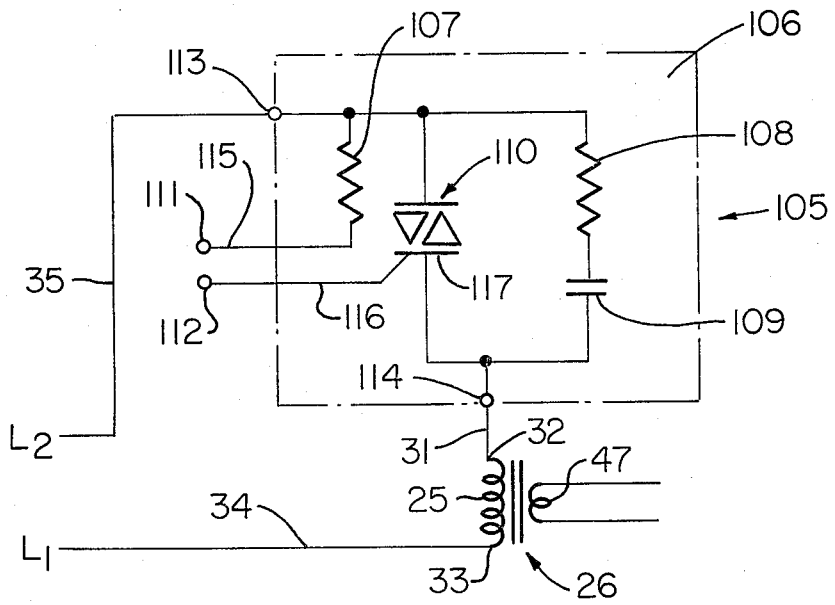
FIG. 7 is a schematic view of the electronic switching means that can be utilized with the fluid flow sensing switch device of FIGS. 2–6.

As previously stated, the system 20 of this invention can utilize the electronic switching means 105 of FIGS. 1 and 7 if desired, the electronic switching means 105 being fully disclosed and claimed in the aforementioned copending patent application, Ser. No. 936,116.

In particular, the electronic switching means 105 as illustrated in FIG. 7 can comprise a potted unit 106 that contains therein a pair of electrical resistors 107, 108, a capacitor 109 and a triac 110 electrically interconnected as illustrated in FIG. 7 so that four terminals 111, 112, 113 and 114 extend therefrom to be electrically interconnected in the leads 31 and 35 of the system of FIG. 20 of FIG. 1.

For example, the terminal 113 of the unit 106 is interconnected to the lead 35 that extends from the power source lead L2 to the unit 106 while the remaining portion of the lead 35 that extends from the unit 106 to the terminal 28 of the fluid flow sensing switch device 27 is interconnected to the terminal 111.

The terminal 114 of the electronic switching unit 106 is interconnected to the portion of the lead 31 that extends from the unit 106 to the side 32 of the primary coil 25 of the transformer 26 while the terminal 112 thereof is interconnected to the portion of the lead 31 of FIG. 1 that extends between the unit 106 and the terminal 29 of the device 27.

As illustrated in FIG. 7, it can be seen that the terminal 111 of the unit 105 is electrically interconnected by lead means 115 to the resistor 107 while the terminal 112 is interconnected by lead means 116 to the gate 117 of the triac 110 which will interconnected the power source lead L2 through the triac 110 to the side 32 of the primary coil 25 of the transformer 26 when the terminals 111 and 112 are interconnected together which happens when the switch construction 30 of the fluid flow sensing switch device 57 of this invention closes for the reasons previously set forth.

Therefore, it can be seen that a relatively small current, because of the resistor 107, will flow through the electrical switch 30 of the device 27 when the contact means 73 thereof are closed in the manner previously described so that arcing between the opening and closing of the contact means 73 of the switch means 30 is held to an absolute minimum to prevent carbon buildup thereon for the reasons advanced in the aforementioned copending patent application, Ser. No. 936,116, while permitting the electronic switching means 105 to interconnect the high voltage, high current power source leads L1 and L2 together through the primary coil 25 of the transformer 26 when the triac 110 senses an electrical current at the gate 117 thereof by the electrically interconnecting together of the terminals 111 and 112.

While the system 20 illustrates the electronic switching means 105 being remote from the device 27 and external thereto so as to be located anywhere on the cooking apparatus as desired, it is a feature of this invention to incorporate the electronic switching means 105 in the housing means 48 of the fluid flow sensing switch device 27 of this invention.

Figure 8:
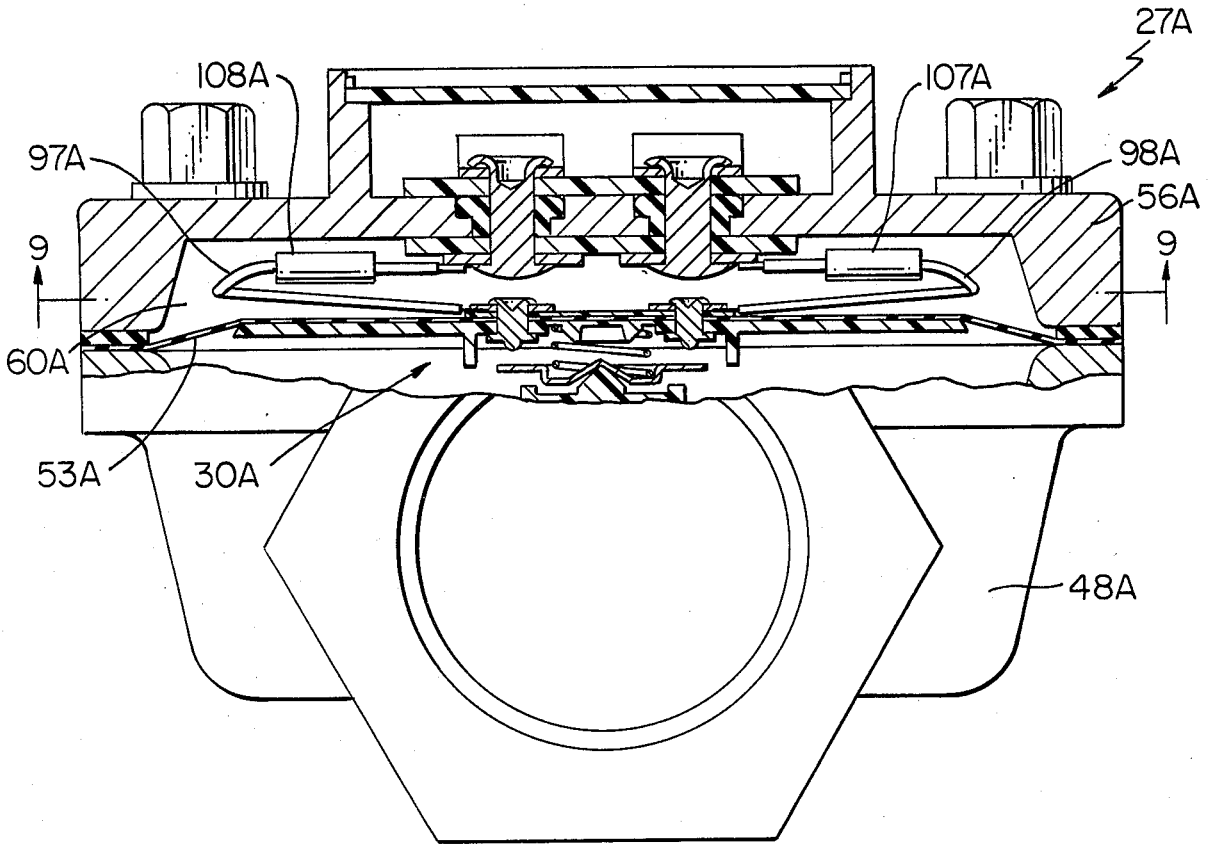
FIG. 8 is a view similar to FIG. 3 and illustrates another fluid flow sensing switch device of this invention.
Figure 9:
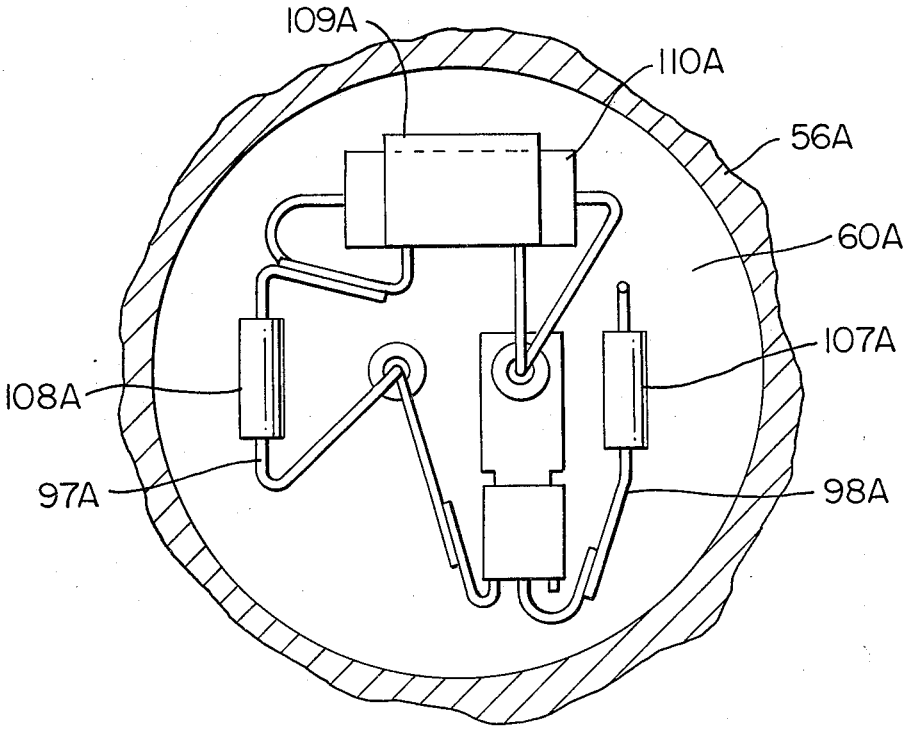
FIG. 9 is a fragmentary, reduced cross-sectional view taken on lines 9—9 of FIG. 8.

In particular, reference is now made to FIGS. 8 and 9 wherein another fluid flow sensing switch device of this invention is generally indicated by the reference numeral 27A and parts thereof similar to the device 27 previously described are indicated by like reference numerals followed by the reference letter "A".

As illustrated in FIG. 8, the device 27A is substantially identical to the device 27 previously described except that the lead means 97A and 98A that are disposed in the control chamber 60A have the components 107A, 108A, 109A and 110A of the electronic switching means 105 incorporated therein so that such electronic switching components 107A–110A not only are disposed within the housing means 48A of the device 27A, but also such components 107A–110A are carried by the cover member 56A and flexible diaphragm 53A so as to be removable therewith for easy repair and replacement services as previously described.

Therefore, it can be seen that the fluid flow sensing switch device of this invention and method of making the same as illustrated in FIGS. 8 and 9 readily permits electronic switching to be utilized in combination with the electrical switch 30A thereof while being contained in the same housing 48A therewith to accomplish the unique function thereof as illustrated in FIGS. 1 and 7 and as set forth in the aforementioned copending patent application, Ser. No. 936,116.

While the device 27 of this invention previously described has the restricted passage means 62 formed in the housing part 55, it was found according to the teachings of this invention, that such restricted passage can form part of the valve member 52, if desired.

Figure 10:
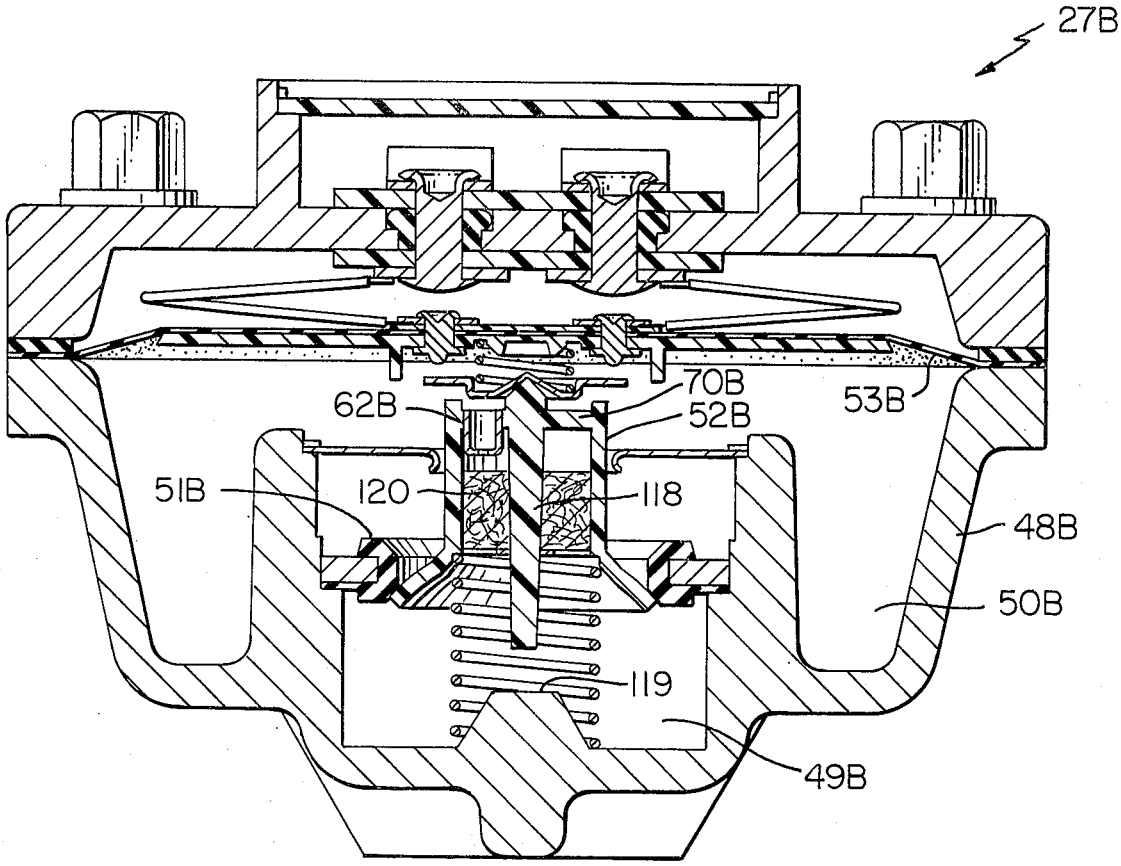
FIG. 10 is a view similar to FIG. 2 and illustrates another embodiment of the fluid flow sensing switch device of this invention.
Figure 6:
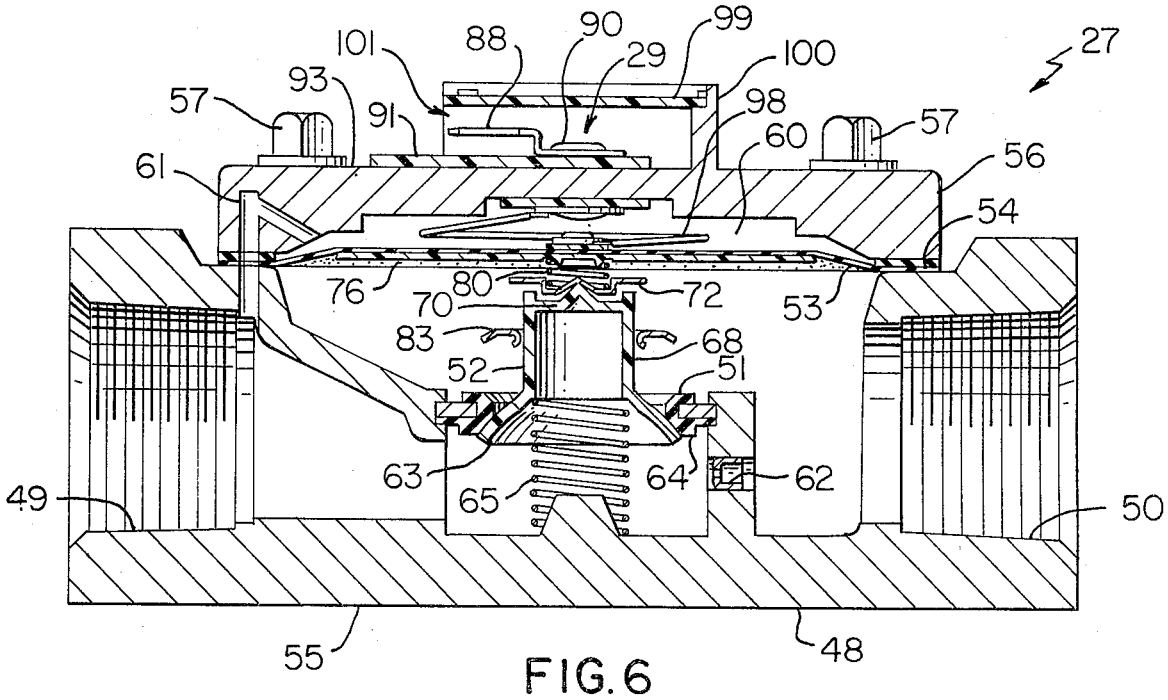
FIG. 6 is a cross-sectional view of the fluid flow sensing switch device of FIG. 2 and is taken in the direction of the arrows 6—6 thereof.

Therefore, reference is now made to FIG. 10 wherein another fluid flow sensing switch device of this invention is generally indicated by the reference numeral 27B and parts thereof similar to the device 27 previously described are indicated by like reference numerals followed by the reference letter "B".

As illustrated in FIG. 10, the device 27B is substantially identical to the device 27 previously described except that the valve member 52B thereof has been modified to include a restricted passage means 62B in the closed end 70B thereof to fluidly interconnect the inlet 49B with the outlet 50B for the same purpose as the restricted passage 62 previously described.

In addition, the valve member 52B of the device 27B can have an extension 118 extending from the closed end 70B thereof to engage against a wall 119 of the housing means 48B when the valve member 52B has been moved to a maximum open position by the diaphragm 53B in the manner previously described to thereby limit the amount of opening movement of the valve member 52B relative to the valve seat 51B.

Also, the valve member 52B can carry fiber material 120 in advance of the restricted passage 62B thereof to thereby filter the flow of fuel from the inlet 49B before the same reaches the restricted passage 62B to thereby eliminate clogging of the passage 62B by dirt and the like that might be entering the inlet 49B with the fuel from the fuel source.

Therefore, it can be seen that this invention not only provides an improved fluid flow sensing switch device and method of making the same, but also this invention provides an improved fuel control system utilizing such a fluid flow sensing switch device.

While the forms and methods of this invention, now preferred, have been illustrated and described as required by the Patent Statute, it is to be understood that other forms and method steps can be utilized and still fall within the scope of the appended claims.

What is claimed is:

1. In a fluid flow sensing switch device having a housing means provided with a fluid flow passage therethrough defined by an inlet and an outlet separated by a valve seat controlled by a movable valve member that is operated by the pressure differential between said inlet and said outlet acting on a flexible diaphragm carried by said housing means, said device having an electrical switch construction operatively associated with said valve member and having contact means thereof disposed in said fluid flow passage so as to be exposed to fluid flow therethrough and being actuated by said pressure differential acting on said flexible diaphragm, the improvement wherein said contact means comprises a pair of spaced apart contacts carried by said flexible diaphragm and a bridging contact member carried by said valve member and being adapted to make contact with said pair of contacts and thereby bridge said pair of contacts to close said switch construction.

2. A device as set forth in claim 1 wherein said bridging contact member is pivotally mounted on said valve member.

3. A device as set forth in claim 1 wherein said bridging contact member is universally mounted on said valve member.

4. A device as set forth in claim 3 wherein said valve member has a substantially point-like projection, said bridging contact member having a concave surface receiving said point-like projection to thereby be universally mounted on said valve member.

5. A device as set forth in claim 4 wherein said bridging contact member comprise a disc-like member.

6. A device as set forth in claim 1 wherein a spring is disposed between said flexible diaphragm and said bridging member to tend to hold said bridging member out of contact with said pair of contacts and thereby maintain said switch construction in an open condition thereof.

7. A device as set forth in claim 1 wherein said housing means carries a pair of terminal means respectively having first parts thereof exposed from said housing means for external lead connection thereto and having second parts thereof internally exposed in said housing means, and a pair of electrical connector means respectively electrically interconnecting said pair of contacts to said second parts of said terminals.

8. A device as set forth in claim 7 wherein said first parts of said terminal means comprise plug-in type prongs for plugging into socket-like means for electrical connection thereto.

9. A device as set forth in claim 7 wherein said flexible diaphragm cooperates with said housing means to define a control chamber therein, said pair of electrical connector means being disposed in said control chamber.

10. A device as set forth in claim 9 wherein said electrical connector means are flexible and thereby flex upon movement of said diaphragm relative to said housing means.

11. A device as set forth in claim 10 wherein said electrical connector means includes electrical control components.

12. A device as set forth in claim 11 wherein one of said components comprises a triac switching unit.

13. A device as set forth in claim 1 wherein said valve member comprises a first part disposed on one side of said valve seat for opening and closing the same and a second part projecting through said valve seat to the other side thereof and carrying said bridging contact member thereon.

14. A device as set forth in claim 13 wherein said housing means carries a washer-like guide member in spaced relation to said other side of said valve seat, said guide member having a central opening therethrough which receives said second part of said valve member to guide movement of said valve member relative to said valve seat.

15. A device as set forth in claim 13 wherein said valve member has restriction means interconnecting one side of said valve seat to the other side thereof.

16. In a fuel control system having a fuel source and a burner means for receiving fuel from said source through a passage defining means to be ignited by electrically operated ignition means, said passage defining means having a fluid flow sensing switch device therein that comprises a housing means provided with a fluid flow passage therethrough defined by an inlet and an outlet separated by a valve seat controlled by a movable valve member that is operated by the pressure differential between said inlet and said outlet acting on a flexible diaphragm carried by said housing means, said device having an electrical switch construction operatively associated with said valve member for operating said ignition means and having contact means thereof disposed in said fluid flow passage so as to be exposed to fluid flow therethrough and being actuated by said pressure differential acting on said flexible diaphragm, the improvement wherein said contact means comprises a pair of spaced apart contacts carried by said flexible diaphragm and a bridging contact member carried by said valve member and being adapted to make contact with said pair of contacts and thereby bridge said pair of contacts to close said switch construction.

17. A system as set forth in claim 16 wherein said bridging contact member is pivotally mounted on said valve member.

18. A system as set forth in claim 16 wherein said bridging contact member is universally mounted on said valve member.

19. A system as set forth in claim 18 wherein said valve member has a substantially point-like projection, said bridging contact member having a concave surface receiving said point-like projection to thereby be universally mounted on said valve member.

20. A system as set forth in claim 19 wherein said bridging contact member comprises a disc-like member.

21. A system as set forth in claim 16 wherein a spring is disposed between said flexible diaphragm and said bridging member to tend to hold said bridging member out of contact with said pair of contacts and thereby maintain said switch construction in an open condition thereof.

22. A system as set forth in claim 16 wherein said housing means carries a pair of terminal means respectively having first parts thereof exposed from said housing means for external lead connection thereto and having second parts thereof internally exposed in said housing means, and a pair of electrical connector means respectively electrically interconnecting said pair of contacts to said second parts of said terminals.

23. A system as set forth in claim 22 wherein said first parts of said terminal means comprise plug-in type prongs for plugging into socket-like means for electrical connection thereto.

24. A system as set forth in claim 22 wherein said flexible diaphragm cooperates with said housing means to define a control chamber therein, said pair of electrical connector means being disposed in said control chamber.

25. A system as set forth in claim 24 wherein said electrical connector means are flexible and thereby flex upon movement of said diaphragm relative to said housing means.

26. A system as set forth in claim 25 wherein said electrical connector means includes electrical control components.

27. A system as set forth in claim 26 wherein one of said components comprises a triac switching unit.

28. A system as set forth in claim 26 wherein said valve member comprises a first part disposed on one side of said valve seat for opening and closing the same and a second part projecting through said valve seat to the other side thereof and carrying said bridging contact member thereon.

29. A system as set forth in claim 28 wherein said housing means carries a washer-like guide member in spaced relation to said other side of said valve seat, said guide member having a central opening therethrough which receives said second part of said valve member to guide movement of said valve member relative to said valve seat.

30. A system as set forth in claim 28 wherein said valve member has restriction means interconnecting one side of said valve seat to the other side thereof.

31. In a fluid flow sensing switch device having a housing means provided with a fluid flow passage therethrough defined by an inlet and an outlet separated by a valve seat controlled by a movable valve member that is operated by the pressure differential between said inlet and said outlet acting on a flexible diaphragm carried by said housing means, said device having an electrical switch construction operatively associated with said valve member and having contact means thereof disposed in said fluid flow passage so as to be exposed to fluid flow therethrough and being actuated by said pressure differential acting on said flexible diaphragm to operate electronic switching means, said diaphragm cooperating with said housing means to define two chambers therein on opposite sides of said diaphragm, said contact means being disposed in one of said chambers that defines part of said fluid flow passage, the improvement wherein said electronic switching means is disposed inside said housing means in the other of said chambers.

32. A device as set forth in claim 31 wherein said other chamber is a control chamber.

33. A device as set forth in claim 32 wherein said housing means includes a main body and a cover member secured to said main body, said diaphragm being secured inside said housing means between said body and said cover member, said cover member carrying said electronic switch means and cooperating with said diaphragm to define said control chamber therewith.

34. A device as set forth in claim 31 wherein said electronic switching means includes a triac switching unit.

35. A device as set forth in claim 31 wherein said electronic switching means includes a plurality of electronic components.

36. A device as set forth in claim 1 and including a spring carried by said housing means and bearing against said bridging contact member to hold the same against said valve member to move in unison therewith and thereby provide the sole means for causing said valve member to carry said bridging contact member.

37. A device as set forth in claim 36 wherein said spring is disposed between said diaphragm and said bridging contact member and also bears against said diaphragm.

38. A system as set forth in claim 16 and including a spring carried by said housing means and bearing against said bridging contact member to hold the same against said valve member to move in unison therewith and thereby provide the sole means for causing said valve member to carry said bridging control member.

39. A system as set forth in claim 38 wherein said spring is disposed between said diaphragm and said bridging contact member and also bears against said diaphragm.

* * * * *